US009638010B2

(12) United States Patent
Kim

(10) Patent No.: US 9,638,010 B2
(45) Date of Patent: May 2, 2017

(54) DOWNHOLE POWER GENERATION SYSTEM WITH ALTERNATE FLOW PATHS

(71) Applicant: Namhyo Kim, Houston, TX (US)

(72) Inventor: Namhyo Kim, Houston, TX (US)

(73) Assignee: CHEVRON U.S.A. INC., San-Ramon, CA (US)

( * ) Notice: Subject to any disclaimer, the term of this patent is extended or adjusted under 35 U.S.C. 154(b) by 215 days.

(21) Appl. No.: 14/496,688

(22) Filed: Sep. 25, 2014

(65) Prior Publication Data

US 2016/0090821 A1 Mar. 31, 2016

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 5,839,508 A 11/1998 Tubel et al.
6,279,651 B1 * 8/2001 Schwendemann .. E21B 41/0035 166/54.1
7,537,053 B1 * 5/2009 Hall ..... E21B 41/0085 166/242.6
2008/0047753 A1 * 2/2008 Hall ..... E21B 41/0085 175/57
2012/0091732 A1 * 4/2012 Fallet ..... E21B 41/0085 290/40 R
2014/0069639 A1 * 3/2014 Mackenzie ..... E21B 23/14 166/250.01

FOREIGN PATENT DOCUMENTS

NL EP 1561899 A1 * 8/2005 ..... E21B 41/0085

* cited by examiner

*Primary Examiner* — Kenneth L Thompson
*Assistant Examiner* — Steven MacDonald
(74) *Attorney, Agent, or Firm* — King & Spalding LLP

(57) ABSTRACT

A downhole power generation device includes a tubular housing configured to be disposed within an annular space and around a portion of production tubing. The housing includes a flow compartment configured to receive a flow of fluid therethrough when the power generation device is in a power generation mode, and an electronics compartment comprising a controller and a power generation unit. The downhole power generation device further includes a turbomachinery system comprising a rotor disposed within the flow compartment and comprising a rotor hub and a plurality of rotor blades, wherein the rotor rotates when the flow of fluid traverses the flow compartment. The downhole power generation device also includes a port coupled to the flow compartment, through which fluid enters the flow compartment.

14 Claims, 5 Drawing Sheets

DOWNHOLE POWER GENERATION SYSTEM WITH ALTERNATE FLOW PATHS

RELATED APPLICATIONS

The present application is related to U.S. patent application Ser. No. 14/496,682, titled "System and Method for Autonomous Downhole Power Generation," and filed concurrently herewith; and U.S. patent application Ser. No. 14/496,673, titled "Downhole Power Generation System and Method," and filed concurrently herewith.

TECHNICAL FIELD

The present application relates to downhole power generation. Specifically, the present application relates to a downhole power generation system with alternative flow paths, which enable a power generation mode and a bypass mode.

BACKGROUND

In certain downhole operations, power is needed to run various components of a downhole assembly. For example, power is need to drive actuators for valves and other components, and to power various sensors and communication devices. In many cases, power is generated downhole via a downhole power generation device that is coupled to the downhole assembly. Some of the devices may be designed to use mechanical power from the fluid flow to generate electric power downhole such as the mechanisms using flow induced vibration, turbomachinery, and the like. However, when such power generation mechanism is designed to run continuously, it must endure a large amount of stress and wear. This leads to a short operating device life. This is a problem because maintenance of such devices is extremely difficult and often impossible, and the expected life of such devices is much shorter than the life of the well. Additionally, such power generation devices typically generate more power than is needed to carry out the functions of the downhole assembly. Thus, the stress and wear seen by the power generation mechanism in generating the excess power does not translate into increased utility.

SUMMARY

In general, in one aspect, the disclosure relates to a downhole power generation system. The downhole power generation system includes a tubular power generation device configured to be disposed in an annular space around a portion of a production tubing, wherein the power generation device is switchable between a power generation mode and a bypass mode. The power generation device includes a power generation path configured to receive a flow of fluid therethrough during the power generation mode. The power generation device also includes a turbomachinery system comprising a rotor disposed within the power generation path, the rotor comprising a rotor hub and a plurality of rotor blades extending from the rotor hub. The rotor hub is partially defined by a central orifice configured to receive the production tubing therethrough, wherein the rotor rotates when the flow of fluid traverses the power generation path. The power generation device also includes a bypass path configured to receive the flow of fluid therethrough during the bypass mode. The power generation device also includes a power generation port and a bypass port. The power generation port is coupled to the power generation path through which fluid enters the power generation path. The bypass port is coupled to the bypass path through which fluid enters the bypass port. The power generation system further includes a power generation unit coupled to the turbomachinery system and configured to convert rotation of the rotor into electricity.

In another aspect, the disclosure can generally relate to a downhole power generation device. The downhole power generation device includes a tubular housing configured to be disposed within an annular space and around a portion of production tubing. The housing includes a flow compartment configured to receive a flow of fluid therethrough when the power generation device is in a power generation mode, and an electronics compartment comprising a controller and a power generation unit. The downhole power generation device further includes a turbomachinery system comprising a rotor disposed within the flow compartment and comprising a rotor hub and a plurality of rotor blades, wherein the rotor rotates when the flow of fluid traverses the flow compartment. The downhole power generation device also includes a port coupled to the flow compartment, through which fluid enters the flow compartment.

In another aspect, the disclosure can generally relate to a downhole power generation system. The downhole power generation system includes a tubular power generation device configured to be disposed in an annular space around a portion of a production tubing, wherein the power generation device is partially defined by an orifice for receiving the production tubing. The power generation device comprises a first end through which a flow of fluid can enter the power generation device, a second end opposite the first end, and a power generation path extending from the first end and the second end. The power generation path comprises a rotor disposed around the orifice, the rotor comprising a rotor hub and a plurality of inward facing rotor blades, wherein the rotor rotates when a flow of fluid traverses the rotor. The power generation device further may include at least one bearing disposed around the rotor hub, at least one stationary coil disposed around the rotor hub, and at least one rotating magnet disposed around the rotor hub and configured to rotate with the rotor and with respect to the at least one coil, generating electricity.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
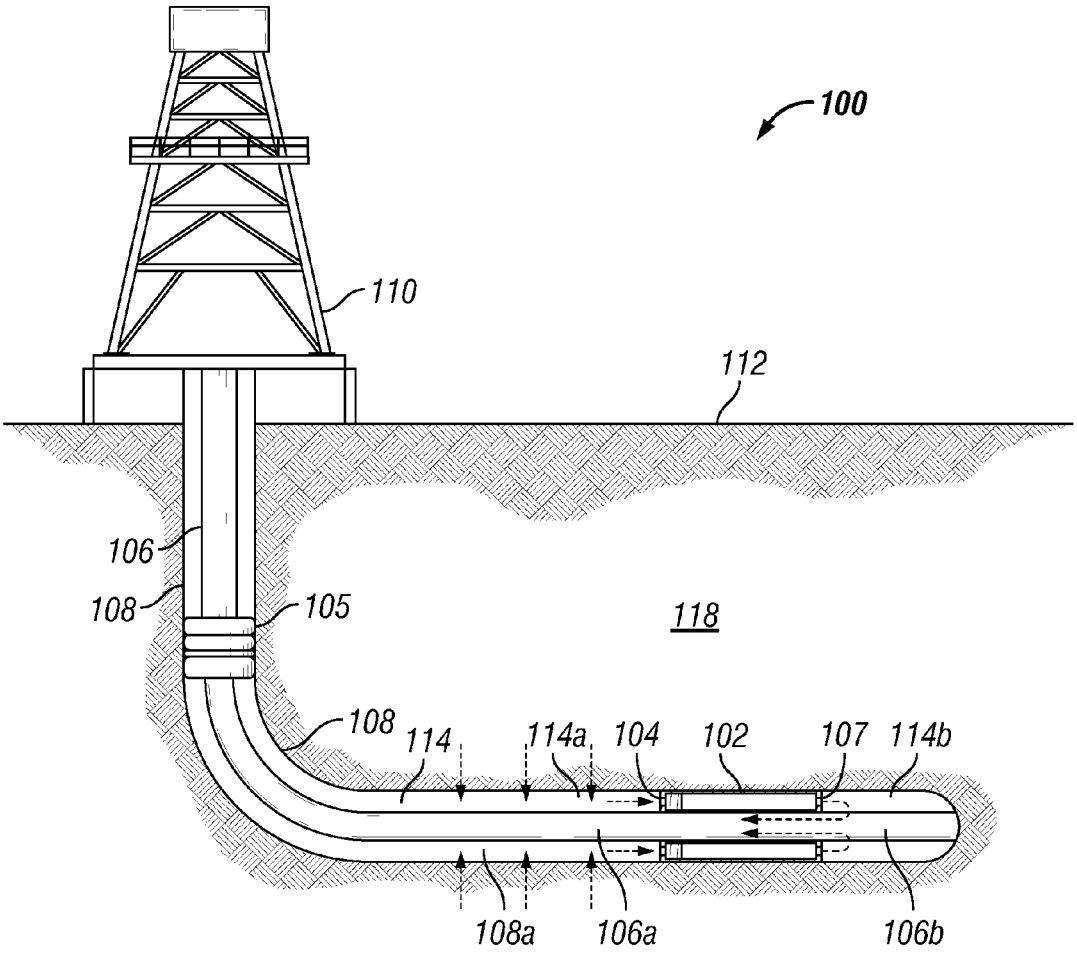
FIG. 1 illustrates a schematic diagram of a well site in which a downhole power generation system has been deployed, in accordance with example embodiments of the present disclosure.

Example embodiments directed to a downhole power generation system and method will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. The example embodiments illustrated herein include certain components that may be replaced by alternate or equivalent components in other example embodiments as will be apparent to one of ordinary skill in the art.

Referring now to the drawings, FIG. 1 illustrates a schematic diagram of a well site 100 in which a downhole power generation system 102 has been deployed, in accordance with example embodiments of the present disclosure. In certain example embodiments, and as illustrated, the downhole power generation system 102 (hereinafter "power generation system") is deployed in a wellbore 108. The wellbore 108 is formed in a subterranean formation 118 and coupled to a rig 110 on a surface 112 of the formation 118. The formation 118 can include one or more of a number of formation types, including but not limited to shale, limestone, sandstone, clay, sand, and salt. The surface 112 may be ground level for an on-shore application or the sea floor for an off-shore application. In certain embodiments, a subterranean formation 118 can also include one or more reservoirs in which one or more resources (e.g., oil, gas, water, steam) are located. In certain example embodiments, the wellbore 108 is cased with cement or other casing material, which is perforated to allow fluids to flow from the formation 118 into the well 108. In certain example embodiments, the well 108 is a multi-zone well. A production tubing 106 is disposed downhole within the well 108. Fluids are recovered and brought to the rig 110 through the production tubing 106. In certain example embodiments, a production packer 105 is coupled to the production tubing 106.

Figure 2:
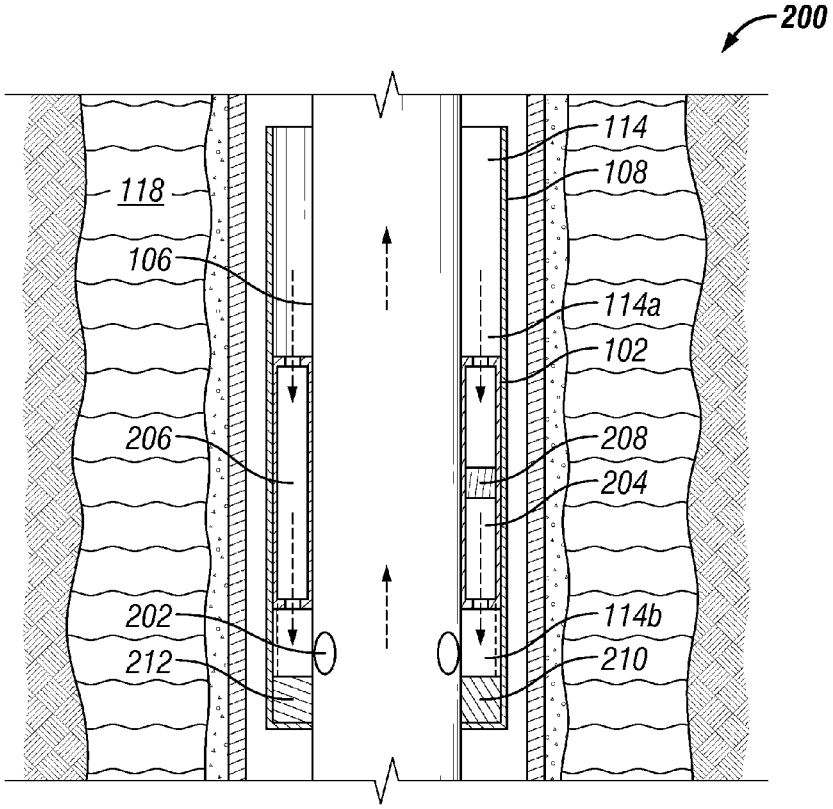
FIG. 2 illustrates a cross-sectional diagram of a downhole power generation system disposed around the production tubing, in accordance with example embodiments of the present disclosure.

In certain example embodiments, the power generation system 102 is disposed in an annular space 114 around a portion of the production tubing 106. FIG. 2 illustrates a cross-sectional diagram 200 of the power generation system 102 disposed around the production tubing 106, in accordance with example embodiments of the present disclosure. Referring to FIGS. 1 and 2, in certain example embodiments, the power generation system 102 is sealed between the production tubing 106 and the wellbore 108 such that fluid traveling from a first portion of the annular space 114*a* to a second portion of the annular space 114*b* is forced to travel through the power generation system 102, in which the first portion of the annular space 114*a* is adjacent a first end 104 of the electric power generation system 102 and the second portion of the annular space 114*b* is adjacent a second end 107 of the power generation system 102. In certain example embodiments, a portion of the wellbore 108 adjacent the first portion of the annular space 114*a* is perforated, allowing production fluid to flow into the first portion of the annular space 114*a*.

In certain example embodiments, a first portion of the production tubing 106*a* adjacent the first portion of the annular space 114*a* and the first end 104 of the power generation system 102 is not perforated, such that production fluid flowing into the first portion of the wellbore 108*a* does not flow directly into the first portion of the production tubing 106*a*. Rather, in certain example embodiments, production fluid flowing into the first portion of the wellbore 108*a* is forced to flow through the power generation system 102 and into the second portion of the annular space 114*b*. In certain example embodiments, a second portion of the production tubing 106*b* adjacent the second portion of the annular space 114*b* contains flow control valves 202, which allow the production fluid to flow from the second portion of the annular space 114*b* into the production tubing 106. The production fluid can then travel to the surface 112 where it is recovered.

In certain example embodiments, the inside of the production tubing 106 is only in communication with the annular space 114 via the power generation system 102, and thus production fluid is forced to travel through the power generation system 102 in order to enter the production tubing 106 and ultimately be recovered. In certain example embodiments, flow of production fluid through the power generation system 102 engages a power generation mechanism in the power generation system. This allows the power generation system 102 to generate power, which is stored in a power storage device 210, such as a rechargeable battery, capacitor, or the like.

In certain example embodiments, and as best shown in FIG. 2, the power generation system 102 includes at least one power generation path 204 and at least one bypass path 206. In certain example embodiments, production fluid must travel through either the power generation path 204 or the bypass path 206 in order to enter the production tubing 106. In certain example embodiments, the power generation path 204 includes one or more power generation mechanisms 208 disposed therein, which generate power when traversed by the flow of production fluid. In certain example embodiments, the power generation mechanism 208 can include piezoelectric power generation elements, turbomachinery, or the like. Thus, these components are activated and electric energy is generated when production fluid flows through the power generation path 204.

In certain example embodiments, the bypass path 206 is isolated from the power generation mechanism 208 and provides a path for production fluid to flow through the power generation system 102 without interacting with the power generation mechanism 208. The power generation mechanism 208 is bypassed and does not generate power when fluid flows only through the bypass path 206.

Both the power generation path 204 and the bypass path 206 provide a path for production fluid to travel through. In certain example embodiments, the power generation path 204 and the bypass path 206 can be opened and closed in order to direct production fluid through the selected path. In certain example embodiments, the bypass path 206 is closed when the power generation path 204 is open. Thus, production fluid must travel through the power generation path 204 and activate the power generation mechanism 208, thereby generating power. Alternatively, in certain example embodiments, the bypass path 206 is opened when the power generation path 204 is closed. As such, production fluid flows through the bypass path 206 and the flow is isolated from the power generation mechanism 208. Thus, the power generation mechanism is not active. This allows the power generation mechanism to rest when power generation is not needed, which increases the overall life of the power generation mechanism. In certain example embodiments, the bypass path 206 and the power generation path 204 can be open at the same time.

In certain example embodiments, the power generation system 102 can be controlled to switch between a power generation mode and a bypass mode. Accordingly, when the power generation system 102 is in the power generation mode, the power generation path 204 is open, production fluid flows therethrough. The power generation mechanism 208 is activated, and power is generated. In certain example embodiments, the generated power is saved in the power storage device 210. The power stored in the power storage device can then be used to power various electronic parts of the downhole assembly, such as actuators, valves, sensors, communication modules, and other devices. When the power generation system 102 is in the bypass mode, the power generation path 204 is closed, production fluid flows through the bypass path 206, and power is not generated.

In certain example embodiments, the power generation system 102 includes a control system 212, which includes various control components such as a microprocessor, sensors, controllers, and the like. In certain example embodiments, the control system 212 controls the switching of the power generation system 102 between the power generation mode and the bypass mode. In certain example embodiments, the control system 212 controls the switching based on one or more parameters or predetermined operational conditions. For example, in a first group of embodiments, the control system 212 controls the switching based on actual power demand by measuring the amount of power currently stored in the power storage device 210. In certain such embodiments, the control system 212 senses the power level of the power storage device 210 via one or more sensors and compares the power level to a first threshold level. If the measured power level is below the first threshold level, then the control system 212 switches the power generation system 102 into the power generation mode. In certain example embodiments, when the power generation system 102 is in the power generation mode, the control system 212 may switch the power generation system 102 to the bypass mode after a certain period of time, or when the measured power level of the power storage device 210 is above a second threshold value. In certain example embodiments, the second threshold value is higher than the first threshold value. Effectively, the power generation system 102 is used to generate power when the stored power is relatively low and not used when the stored power is still relatively high, rather than continuously generating power regardless of actual demand. This reduces the amount of wear on the power generation mechanism 208, increasing the overall lifespan of the power generation system 102.

In another group of example embodiments, not exclusive of embodiments in the first group, the control system 212 controls switching between the power generation mode and the bypass mode based on current operational conditions, operational demands, and/or a preprogrammed protocol. For example, in one embodiment, the control system 212 switches the power generation system 102 to the power generation mode in anticipation of a power-consuming event such as actuating a valve. In certain example embodiments, the power generation system 102 is put in the power generation mode during or after such an event. In certain example embodiments, the power generation system 102 is put in the bypass mode after such an event occurs. In certain example embodiments, the control system 212 switches the power generation system 102 to the power generation mode at certain time intervals. In certain example embodiments, the control system 212 is preprogrammed to control the power generation system 102 in accordance to a protocol or program. The protocol or program defines the conditions under which the power generation system 102 is to be put in the power generation mode and the conditions under which the power generation system 102 is to be put in the bypass mode. Such conditions may include stored power level, time interval, actuation, certain events, and so forth. This allows the power generation system 102 to autonomously switch between the power generation mode and bypass mode without intervention, and further allows the power generation system 102 to provide maximum utility and reduce waste.

In certain example embodiments, switching between the power generation mode and the bypass mode includes mechanical actuation, such as driving a motor, which mechanically opens and closes the power generation path 204 and the bypass path 206. In certain example embodiments, the switching includes expansion and contraction, or axial movement of a plug or packer type device in the power generation path 204 and the bypass path 206, in which the device blocks the respective path when expanded.

Figure 3:
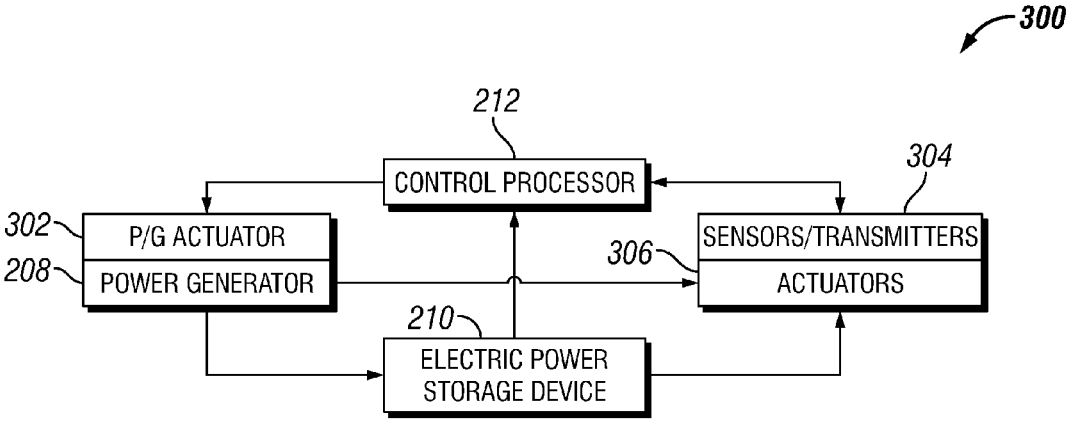
FIG. 3 illustrates a block diagram of a downhole power generation system, in accordance with example embodiments of the present disclosure.

FIG. 3 illustrates a block diagram 300 of the power generation system 102, in accordance with example embodiments of the present disclosure. In certain example embodiments, the block diagram 300 includes the control system 212, the power storage device 210, the power generator mechanism 208 which is coupled to a power generator actuator 302, and one or more actuators 306 and sensors or transmitters 304 that the downhole assembly may have. In certain example embodiments, the control system 212 sends control commands to the power generator actuator 302, which then actuates the power generator mechanism 208 accordingly. The power generator mechanism 208 generates power and sends the power to be stored in the power storage device 210. The power storage device 210 provides power to the control system 212, the actuators 306, and sensors and transmitters 304. In certain example embodiments, the control system 212 also controls and communicates with the sensors/transmitters 304 which are coupled to and communicate with the actuators 306. In certain example embodiments, the power storage device 210 provides a signal to the control system 212 indicative of the amount of power stored in power storage device 210.

Figure 4:
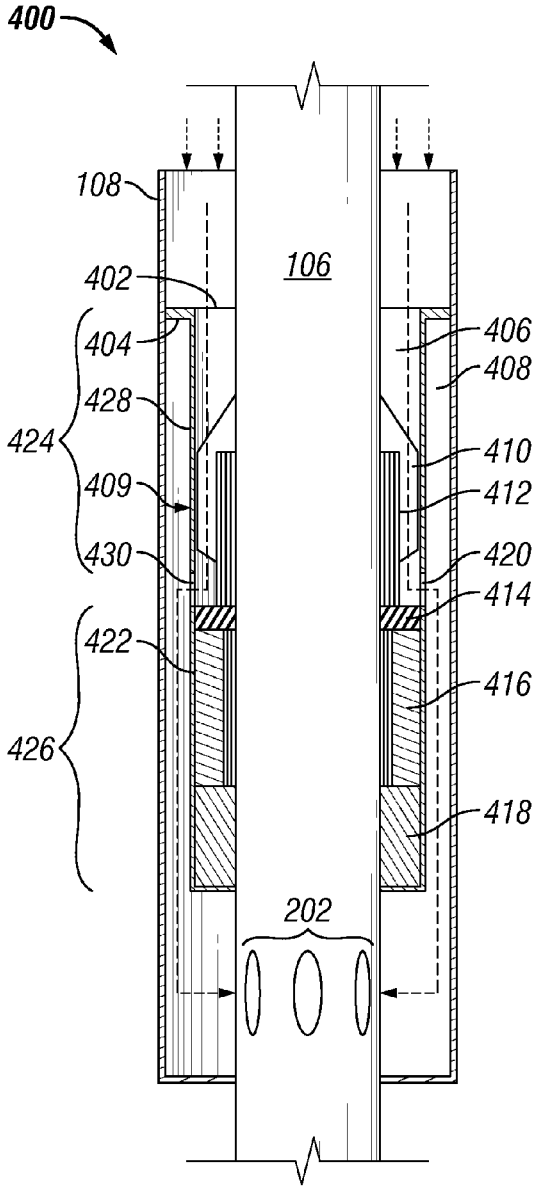
FIG. 4 illustrates a cross-sectional view of a downhole power generation device in a power generation mode, in accordance with example embodiments of the present disclosure.
Figure 5:
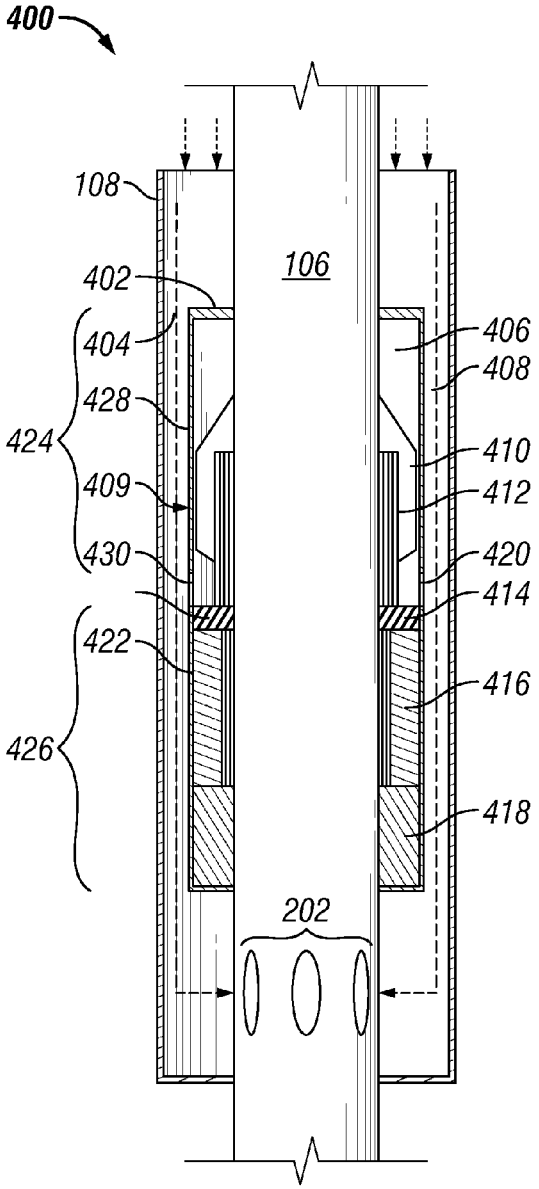
FIG. 5 illustrates a cross-sectional view of a downhole power generation device in a bypass mode, in accordance with example embodiments of the present disclosure.

FIGS. 4 and 5 illustrate cross-sectional views of a downhole power generation device 400, in accordance with example embodiments of the present disclosure. Specifically, FIG. 4 illustrates the device 400 in a power generation mode and FIG. 5 illustrates the device in a bypass mode, in accordance with example embodiments of the present disclosure. Referring to FIGS. 4 and 5, the power generation device 400 includes a power generation path 406. In certain example embodiments, the power generation device 400 also includes a bypass path 408. In certain example embodiments, the power generation path 406 includes a power generation port 402, through which production fluid can enter the power generation path 406. In certain example embodiments, the power generation port 402 can be controlled to open or close. When the power generation port 402 is open, as illustrated in FIG. 4, fluid is able to flow through the power generation path 406. When the power generation port 402 is closed, as illustrated in FIG. 5, fluid is prevented from flowing through the power generation path 406. Instead, fluid flows through the bypass path 408. In certain example embodiments, the bypass path 408 includes a bypass port 404 which controllably opens and closes the bypass path 408.

Figure 6:
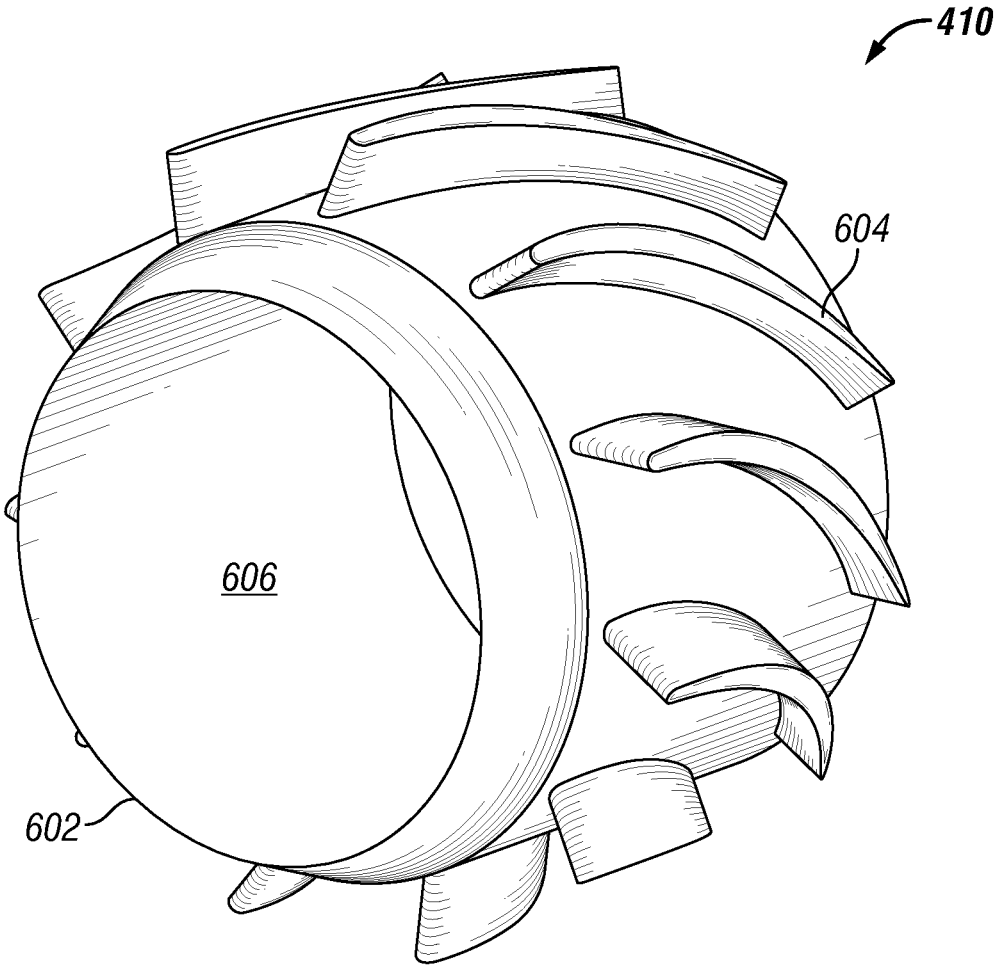
FIG. 6 illustrates a perspective view of a rotor, in accordance with example embodiments of the present disclosure.

The power generation path 406 further includes a turbomachinery system 409 disposed within the power generation path 406. The turbomachinery system 409 includes a rotor 410 disposed within the power generation path 406. FIG. 6 illustrates a perspective view of a rotor 410, in accordance with example embodiments of the present disclosure. Referring to FIGS. 4, 5, and 6, the rotor 410 includes a rotor hub 602 and a plurality of rotor blades 604 extending from the rotor hub 602. In certain example embodiments, the rotor blades 604 are curved. The rotor hub 602 forms a central opening 606 through which the production tubing 106 is disposed. The turbomachinery system 409 also includes a bearing and support assembly 412 which couples the rotor 410 to a power generation unit 416. The power generation unit 416 includes components that convert the rotational motion of the turbomachinery system 409 into electricity. The power generation unit 416 can include various types of power generation components such as electromagnetic power generation components, piezoelectric power generation components, and others. In certain example embodiments, the power generation device 400 further includes one or more electronic components 418 such as a power storage device and/or a controller/processor.

In certain example embodiments, the power generation device 400 includes a housing 422. The housing 422 includes a flow compartment 424 and an electronics compartment 426. In certain example embodiments, the flow compartment 424 includes a wall 428 separating the power generation path 406 and the bypass path 408. In certain example embodiments, an opening 430 in the wall 430 allows fluids to flow out of the power generation path 406 after it flows past the turbomachinery system 409. The electronics compartment 426 houses the power generation unit 416 and the electronic components 418, and isolates them from the production fluid. In certain example embodiments, the electronics compartment 426 is isolated via a sealed coupling 414, which transmits the torque from turbomachinery rotor 410 to the power generation unit 416 and prevents production fluid from seeping into the electronics compartment.

Figure 7:
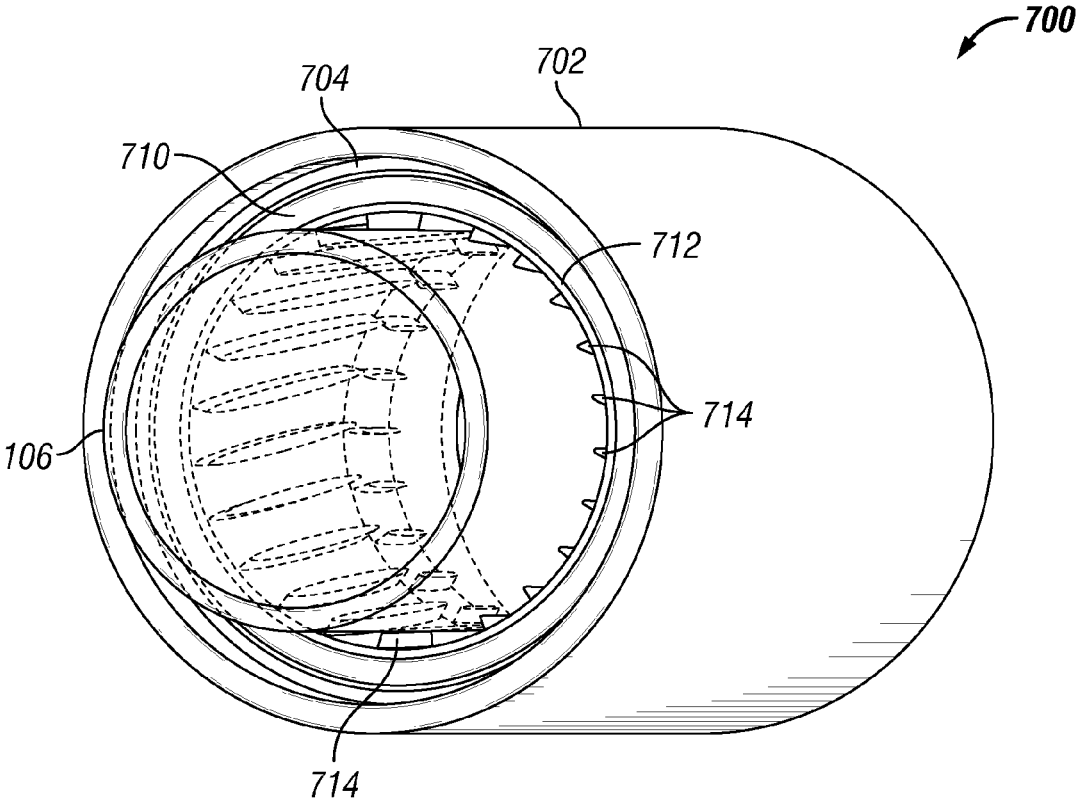
FIG. 7 illustrates a perspective view of a downhole power generation device in accordance with another example embodiment of the present disclosure.
Figure 8:
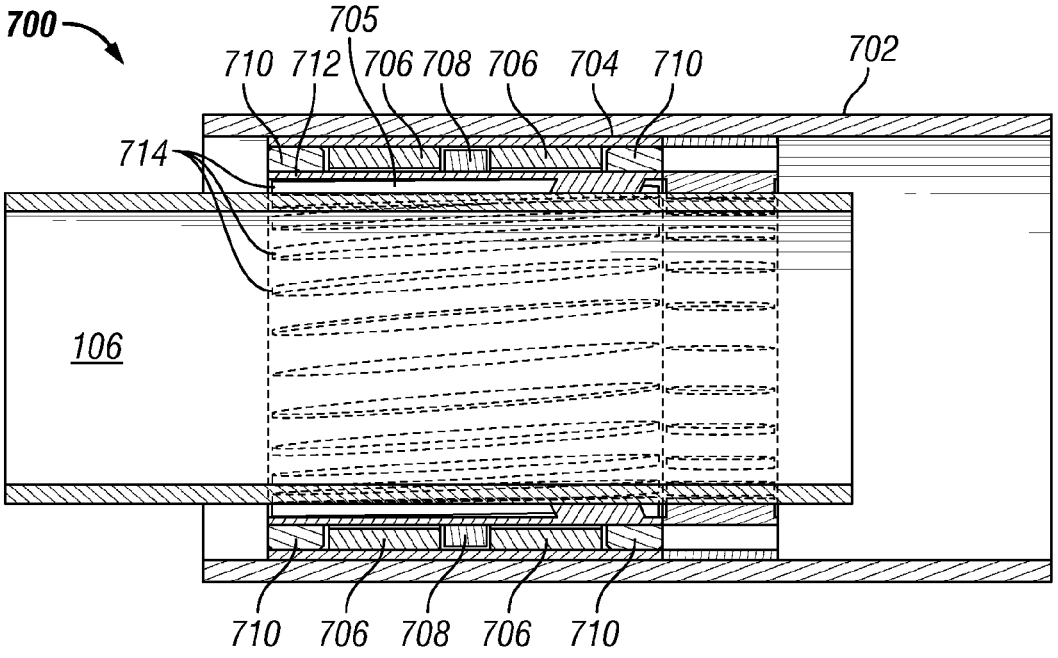
FIG. 8 illustrates a cross-sectional view of the downhole power generation device of FIG. 7, in accordance with another example embodiment of the present disclosure.

FIG. 7 illustrates a perspective view of a power generation device 700 and FIG. 8 illustrates a cross-sectional view of the power generation device 700, in accordance with another example embodiment of the present disclosure, wherein the turbomachinery system and the electric power generation system are directly combined as one body, and wherein the bypass path is outside the tubular housing 702 and is not shown in the figure. Referring to FIGS. 7 and 8, the power generation device 700 may include a tubular housing 702, a generator housing 704, and rotor 705 disposed within the housing 702. The rotor 705 includes a rotor hub 712 and a plurality of rotor blades 714 extending from the rotor hub 712. In certain example embodiments, the rotor blades 714 extend inwardly such that when the power generation device 700 is disposed downhole and around a production tubing 106, the rotor blades 714 extend from the rotor hub 712 towards the production tubing 106.

In certain example embodiments, the power generation device 700 further includes one or more coils 706, one or more rotating magnets 708, and one or more bearings 710. The coils 706 are coupled to and stationary with respect to the tubular housing 702. The rotating magnet 708 is coupled to the rotor hub 712. Thus, when the rotor 705 rotates, the rotating magnet 708 rotates with the rotor 705 and the coils 706 remain stationary with the tubular housing 702. Rotation of the rotating magnet 708 with respect to the coils 706 generates electricity. In certain example embodiments, the coils 706 and the rotating magnet 708 are disposed around the generator housing 704 and adjacent each other. In certain example embodiments, the rotating magnet 708 is disposed between a plurality of coils 706. In certain example embodiments, the bearings 710 are disposed around the generator housing 704 and in between the generator housing 704 and the rotor hub 712. In certain example embodiments, the bearings 710, the coils 706, and the rotating magnet 708 form a tubular layer between the rotor hub 712 and the generator housing 704. In certain example embodiments, the coils 706 and the rotating magnet 708 are oriented in a different configuration than the illustrated example. For example, the coils 706 can be coupled to the rotor 705 and the rotating magnet can be coupled to the generator housing 704. In certain example embodiments, the tubular housing 702 may include an inner tubular wall disposed within the generator housing 704 which separates the rotor 705 and the production tubing 106.

In certain example embodiments, the power generation device 700 includes a bypass path (not shown in FIGS. 7 and 8) through which fluid can traverse the power generation device 700 without interacting with the rotor 705. In certain such example embodiments, the bypass path can be controllably opened or closed. Likewise, the power generation device 700 may also include a controllable mechanism that allows fluid to flow through the rotor 705 or prevent fluid from flowing through the rotor 705. When fluid is allowed to flow through the rotor 705, the force of the fluid pushes the rotor blades 714 and the rotor 705 rotates, thereby generating power via the coils 706 and the rotating magnet 708. During use, the power generation device 700 is disposed in the annular space 114 between the production tubing 106 and the wall of the wellbore 108. In certain example embodiments, the bypass path is formed between the wellbore 108 and the outside of the tubular housing 702, or between the wellbore 108 and the device 700.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A downhole power generation system, comprising:

a tubular power generation device configured to be disposed in an annular space around a portion of a production tubing, wherein the power generation device is switchable between a power generation mode and a bypass mode, the power generation device comprising:

a power generation path configured to receive a flow of fluid therethrough during the power generation mode, a turbomachinery system comprising a rotor disposed within the power generation path, the rotor comprising a rotor hub and a plurality of rotor blades extending from the rotor hub, wherein the rotor rotates when the flow of fluid traverses the power generation path, a bypass path configured to receive the flow of fluid therethrough during the bypass mode;

a power generation port coupled to the power generation path through which fluid enters the power generation path;

a bypass port coupled to the bypass path through which fluid enters the bypass path; and a power generation unit coupled to the turbomachinery system and configured to convert rotation of the rotor into electricity.

2. The downhole power generation system of claim 1, further comprising:

a power storage device electrically coupled to the power generation unit and configured to store power generated by the power generation unit.

3. The downhole power generation system of claim 1, further comprising:

a control processor configured to control opening and closing of the power generation port and the bypass port.

4. The downhole power generation system of claim 3, wherein the control processor controls opening and closing of the power generation port and the bypass port based on the measured power level of a power storage device.

5. The downhole power generation system of claim 1, wherein the power generation unit comprises a electromagnetic power generation system.

6. The downhole power generation system of claim 1, wherein the power generation unit comprises a piezoelectric power generation system.

7. A downhole power generation device, comprising:

a tubular housing configured to be disposed within an annular space and around a portion of production tubing, the housing comprising:

a flow compartment providing a power generation path for a flow of fluid when the power generation device is in a power generation mode;

an electronics compartment comprising a controller and a power generation mechanism; and a bypass path for the flow of fluid when the power generation device is in a bypass mode;

a turbomachinery system comprising a rotor, the rotor disposed within the flow compartment and comprising a rotor hub and a plurality of rotor blades, wherein the rotor rotates when the flow of fluid traverses the flow compartment; and a port coupled to the flow compartment, wherein fluid enters the flow compartment through the port during the power generation mode and wherein the port is closed during the bypass mode.

8. The downhole power generation device of claim 7, wherein the tubular housing is partially defined by a central orifice through which the production tubing is disposed, the rotor hub disposed around the orifice.

9. The downhole power generation device of claim 7, wherein the port is controllable to selectively open and close the flow compartment.

10. The downhole power generation device of claim 9, wherein fluid flows through the bypass path during the bypass mode when the flow compartment is closed.

11. The downhole power generation device of claim 9, wherein opening or closing of the flow compartment is controlled by the controller according to one or more predetermined conditions.

12. The downhole power generation device of claim 11, wherein the one or more predetermined conditions comprises an amount of power stored in a power storage device.

13. The downhole power generation device of claim 7, wherein the power generation mechanism converts rotation of the rotor into electricity via electromagnetic power generation.

14. The downhole power generation device of claim 7, wherein the power generation mechanism converts rotation of the rotor into electricity through piezoelectric power generation.

* * * * *